US009512366B2

(12) United States Patent
Meliana et al.

(10) Patent No.: US 9,512,366 B2
(45) Date of Patent: Dec. 6, 2016

(54) PROCESS TO PRODUCE PROCESS OIL WITH LOW POLYAROMATIC HYDROCARBON CONTENT

(75) Inventors: Yana Meliana, Jakarta (ID); Nunik Supriyantini, Bekasi Barat (ID); Joseph Tundang, Jakarta (ID); Bambang Sudiyatmoko, Di Yogykarta (ID)

(73) Assignees: PT PERTAMINA (PERSERO), Jakarta (ID); PT PURA BARUTAMA, Kudus (ID)

( * ) Notice: Subject to any disclaimer, the term of this patent is extended or adjusted under 35 U.S.C. 154(b) by 0 days.

(21) Appl. No.: 13/698,137

(22) PCT Filed: Apr. 25, 2011

(86) PCT No.: PCT/ID2011/000001

§ 371 (c)(1),
(2), (4) Date: Feb. 19, 2013

(87) PCT Pub. No.: WO2011/145086

PCT Pub. Date: Nov. 24, 2011

(65) Prior Publication Data

US 2013/0144092 A1 Jun. 6, 2013

(30) Foreign Application Priority Data

May 17, 2010 (ID) ..... P00201000338

(51) Int. Cl.

| | |
|---|---|
| ***C10G 21/02*** | (2006.01) |
| ***C10G 21/12*** | (2006.01) |
| ***C10G 53/06*** | (2006.01) |

(52) U.S. Cl.

CPC ..... *C10G 21/02* (2013.01); *C10G 53/06* (2013.01); *C10G 2300/302* (2013.01);

(Continued)

(58) Field of Classification Search

CPC ..... C10G 21/02
USPC ..... 585/24, 837
See application file for complete search history.

(56) References Cited

U.S. PATENT DOCUMENTS

| | | | |
|---|---|---|---|
| 2,114,524 | A | 4/1938 | Heinrich |
| 2,115,960 | A | 5/1938 | Lindeke |

(Continued)

FOREIGN PATENT DOCUMENTS

| | | | |
|---|---|---|---|
| EP | 0 489 371 | A1 | 6/1992 |
| EP | 0 417 980 | B1 | 6/1997 |

(Continued)

OTHER PUBLICATIONS

Delta Controls Corp., Jul. 17, 1997, Dielectric constants of various materials.*

(Continued)

*Primary Examiner* — In Suk Bullock
*Assistant Examiner* — Youngsul Jeong
(74) *Attorney, Agent, or Firm* — Cozen O'Connor

(57) ABSTRACT

Process for TDAE-1 and TDAE-2 production is initiated with production of DAE Feeds which have kinematic viscosity at 100° C. ranges 24-67 cSt, followed by mixing them with solvent to yield Mixture of DAE Feed with density ranges 0.75-0.85 kg/liter and further contacting the Mixture of DAE Feed with solvent, like furfural, NMP and DMSO to facilitate a counter current liquid-liquid extraction, wherein the TDAE-1 and TDAE-2 are produced at ratio of polar solvent to Mixture of DAE Feed ranges 1.7-2.0 and 0.5-1.7, respectively. The PCA content of TDAE-1 and TDAE-2 are less than 3% weight and 3-20% weight. The amount of 8 Grimmer polyaromatics hydrocarbon content in the TDAE-1 and TDAE-2 are the same, that is, less than 10 mg/kg including Benzo (a) pyrene substance as much as less than 1 mg/kg.

5 Claims, 1 Drawing Sheet

(52) U.S. Cl.
CPC ..... *C10G 2300/308* (2013.01); *C10G 2300/4025* (2013.01); *C10G 2300/44* (2013.01); *C10G 2300/802* (2013.01); *C10G 2400/18* (2013.01)

(56) References Cited

U.S. PATENT DOCUMENTS

| | | | | |
|---|---|---|---|---|
| 2,220,016 | A | 10/1940 | Lyons | |
| 2,932,612 | A | 4/1960 | Galstaun et al. | |
| 3,492,365 | A | 1/1970 | Anderson et al. | |
| 3,567,626 | A | 3/1971 | Bozeman, Jr. et al. | |
| 5,840,175 | A | 11/1998 | Aldous et al. | |
| 5,853,569 | A | 12/1998 | Aldous et al. | |
| 6,146,520 | A * | 11/2000 | Gupte et al. | 208/322 |
| 6,923,915 | B2 * | 8/2005 | Alford et al. | 210/634 |

FOREIGN PATENT DOCUMENTS

| | | | |
|---|---|---|---|
| EP | 0 839 891 | A2 | 5/1998 |
| EP | 0 950 703 | A3 | 1/2000 |
| FR | 2 685 705 | | 7/1993 |
| GB | 630 245 | | 10/1949 |
| GB | 1 390 953 | | 4/1975 |
| WO | WO 98/44075 | * | 2/1998 |
| WO | WO 98/44075 | A1 | 10/1998 |
| WO | WO 01/77257 | A1 | 10/2001 |

OTHER PUBLICATIONS

PCT International Search Report dated Apr. 27, 2012, 8 pages.

* cited by examiner

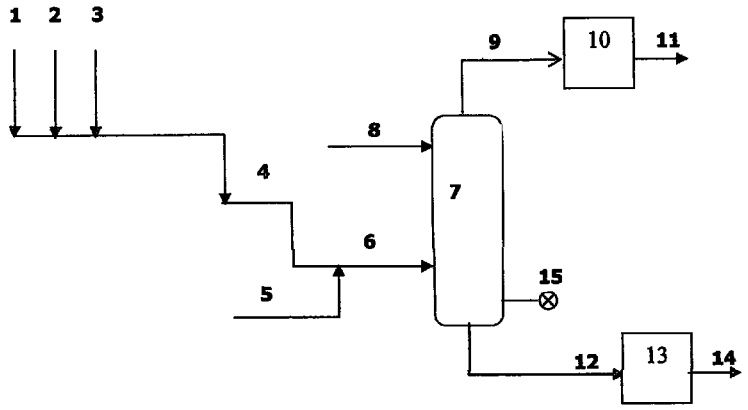
1
2
3
4
5
6
7
8
9
10
11
12
13
14
15

PROCESS TO PRODUCE PROCESS OIL WITH LOW POLYAROMATIC HYDROCARBON CONTENT

CROSS REFERENCE TO RELATED APPLICATIONS

This is a U.S. national stage of application no. PCT/ID2011/000001, filed on 25 Apr. 2011. Priority is claimed on Indonesian Patent No. P00201000338 filed 17 May 2010, the content of which is incorporated here by reference.

FIELD OF THE INVENTION

This Invention relates to a process for producing process oil by means of reextraction of distillate aromatic extract (DAE) at lubricant oil processing. More specifically, the present invention relates to liquid-liquid extraction process from DAE feed which resulted treated distillate aromatic extract (TDAE) that have low content of polyaromatic hydrocarbon (PAHs) and content of polycyclic aromatic (PCA) less than 3%.

BACKGROUND OF THE INVENTION

The worlds demand of process oil is estimated around 1,000,000 ton per year, including the European that consumed about 250,000 ton. This process oil consists of various types, such as DAE, residual aromatic extract (RAE), mild extraction solvate (MES), and naphthenic oil.

In the latest development of process oil utilization in rubber industry, there is effort by the European Commission to restrict the use of process oil since it is categorized as carcinogenic substance. The European Commission has published restriction order 2005/69/EC (European legislation) about the level of carcinogenic compound in process oil that consist of eight types polyaromatic hydrocarbon (8 Grimmers PAH) with amount of less than 10 mg/kg, wherein one of them is Benzo(a)pyrene (BaP) with amount of less than 1 mg/kg. The limit of 8 Grimmers PAH are assumed equivalent to polycyclic aromatic (PCA) content less than 3% weight. This regulation is effective on 1 Jan. 2010. The eight (8) substances of PAH, referred are Benzo(a)pyrene (BaP), Benzo(e)pyrene(BeP), Benzo(a)antracene(BaA), Chrysene(CHR), Benzo(b)fluoranthene (BbFA), Benzo(j) fluoranthene(BjFA), Benzo(k)fluoranthene (BkFA) and Dibenzo(a,h)antracene (DBAhA). The Measurement of 8 Grimmer PAH content can be conducted by means of Gas Chromatography Mass Spectrometer Isotope dilution method (GCMS-SIM), while PCA content can be analysed gravimetricaly according to IP-346 method.

The challenges that may arise as the consequence of the European legislation mentioned above is that rubber industries need to conduct adjustment in the course of their production, such as change the resulted DAE into alternative products like TDAE, treated residual aromatic extract (TRAE), MES, and naphtenic oil. This adjustment will cause additional production costs which vary depending on the type of alternative process oil being produced. The lowest additional production cost may be obtained when TDAE type of process oil is chosen.

Many efforts to produce alternative process oil have been conducted, especially utilizing liquid-liquid extraction method to produce TDAE with an objective to reduce level of PCA compound up to less than 3% weight. In the present invention the IP-346 analysis method can only measure the amount of PCA compound as a group of aromatic compound, though the group of PAH compound that contained in the group of aromatic (PCA) must be analyzed, as well.

One of the important consideration published in the European Commission 2005/69/EC (European legislation) confirmed the restriction that the level of 8 Grimmers PAHs especially Benzo(a)pyrene (BaP) with amount exceeding the allowed limit will be considered as carcinogenic, mutagenic and toxic, and thereby will be prohibited to produce and distribute within the European legislation area. The presence of PAHs can be detected qualitatively and quantitatively using Benzo(a)Pyrene (BaP) as marker. Commonly known method to measure carcinogenic and mutagenic compound is ASTM E 1687-98 method (Ames test method for determining carcinogenic potential of Virgin Base Oils in Metalworking Fluids) and also Ames test based on OECD Guidelines for Testing of Chemicals No 471(1997). In the present invention method of AMES test using *Salmonella typhimurium* TA 1535 as microbes that is very sensitive to mutagenic compounds.

In this invention Gas Chromatography Mass Spectrometer (GCMS) based on isotope dilution methods have been applied to analyze and calculate the PAH contained in the DAE Feed and TDAE products.

Former method relates to process oil production which is closest related to the present invention is that of EP 0417980A1. In this European patent document, the feed that is used is an extract with kinematic viscosity value at temperature of 100° C. is limited to a value of 30.5 cSt whereas in the present invention is more flexible since the extract feed being used have kinematic viscosity values at temperature 100° C. ranges from 5 to 100 cSt, preferably between 10 to 80 cSt, and more preferably 15-70 cSt. Still in the patent document EP 0417980A1 it is found that the method of processing that is used is highly complicated, for example it requires very tight control on the temperature system and the occurance of pseudo-raffinate flow. Both of this conditions need special equipments and energy, whereas in the present invention the diluent used can simplify the flow of process, so that liminate the pseudo-raffinate flow which occurs in the European Patent EP 0417980A1. This European patent document describes that the tight control of temperature in the extraction column ranges from 50 to 90° C. on the upper portion of the column and 20 to 60° C. in the lower portion of the column. This case does not happen in the present invention since the temperature is controlled isothermically in the whole of extraction column at 22-35° C. (ambient temperature) so that the expenses for processing become cheaper than that of European Patent EP 0417980A1. In the former related method which is mentioned in the American Patent Document U.S. Pat. No. 6,802,960 B1 it is stated that component of aromatic compounds content in the second extract product is minimum 20% weight, whereas in the present invention the component of aromatic compound is larger than 25% weight, even can reach as much of 30 to 37% weight.

Note that the reference used in the production of TDAE of the prior arts is PCA compound with maximum content of 3% weight, whereas in the present invention the effort to fulfill the requirement of 8 Grimmer PAH in the level of PCA less than 3% and in the PCA level ranges from 3% to 20% weight is more preferred.

SUMMARY OF THE INVENTION

In the embodiment of this invention, initial feeds, that is DAE-1, DAE-2 and DAE-3, are processed into DAE feeds that consist of mixing two DAE Feed or three DAE Feed at once. Determination of component of the formula of DAE Feed is defined base on the kinematic viscosity at temperature of 100° C. of the three DAEs, that is, DAE-1: 14-17 cSt, DAE-2: 19-35 cSt dan DAE-3: 52-67 cSt, respectively. The mixing of these three type of DAE will produce DAE Feed that have kinematic viscosity at temperature of 100° C. as high as 24-57 cSt with density 0.99-1.20 kg/liter.

This present invention discloses a process of TDAE production conducted through steps as follow; mixing the DAE Feed obtained from the above mixing process with a diluent in-line or off-line to give rise to flow of Mixture of DAE Feed at density of 0.75-0.85 kg/liter; guiding the flow direction of Mixture of DAE Feed toward the extractors that have isothermic temperature conditions; contacting the feed flow with certain solvent, such as furfural, N-methyl pyrrolidone (NMP), and dimethylsulfoxide (DMSO) to carry out a counter current liquid-liquid extraction at the appropriate isothermic temperature, that is, 22 to 35° C.

In the extraction column there is a separation process between mixture of raffinate and mixture of extract where the interface layers of both mixtures can be arranged through a control equipment placed at the lower section of the column. Time of the feed retention in the column to form mixture of raffinate ranges from 5 minute to 30 minute. The flow of raffinate mixture is guided into a Solvent Recovery Unit to dissociate solvent components, like furfural, NMP and DMSO and diluent from mixture of raffinate to produce end product so-called TDAE. In the present invention, the resulted two types of TDAE (TDAE-1 dan TDAE-2) both contain PAH less than 10 mg/kg and BaP less than 1 mg/kg. TDAE-1 contains PCA less than 3% weight, while TDAE-2 contains PCA 3%-20% weight.

The flow of mixture of extract that is still rich in polar solvent is separated out of the solvent to bring out extract that have a very high aromatic content so-called high aromatic concentrated extract (HACE), collecting solvent components, like furfural, NMP and DMSO and diluent that has been separated in one particular container to be used at next extraction process.

BRIEF SUMMARY OF THE FIGURE

The following drawing forms part of the present specification and is included to further demonstrate certain aspects of the present invention. The invention may be better understood by reference to this drawing in combination with the detailed description of specific embodiments presented herein.

FIG. 1 is diagram flow of process on Blending of DAE Feed, Mixture of DAE Feed and TDAE-1 and TDAE-2 productions.

DETAILED DESCRIPTION OF THE INVENTION

While the present invention is described related to the embodiments as illustrated herein after, as well as the accompanied drawing, it has to be understood that they are not intended to represent the only form of the invention in regard to the details of the process and manner of operation. In fact, it will be evident to one skill in the art that modifications and variations may be made without departing from the spirit and the scope of the invention. Although specific terms have been employed, they are intended in a generic and descriptive sense only and not for the purpose of limitation.

FIG. 1 explains the flow diagram of TDAE-1 and TDAE-2 production. Flows (1, 2, and 3) illustrate the mixing process of one, two or three types of DAE to yield the DAE Feed (4). The mixing process are conducted at the kinematic viscosity desired, at temperature of 100° C., that is, 24-67 cSt and density 0.98-1.20 kg/liter. The formula determinations are based on the kinematic viscosities at temperature of 100° C. for each component of DAE-1, DAE-2 and DAE-3, respectively. Mixing process are conducted in in-line or off-line and completed with stirring in a container. After the DAE Feeds are available, the process continued with making Mixture of DAE Feed (6) by dissolving diluents (5) into the flow of Mixture of DAE Feed to yield density of Mixture of DAE Feed 0.75-0.85 kg/liter and further guided into the extractor (7). At the same time, the flow of polar solvent (8) is being contacted with the Mixture of DAE Feed (6) with the counter current method so that it forms a separate mixture of raffinate phase (9) and mixture of extract phase (12). The mixture of raffinate phase and mixture of extract phase then are guided to the Recovery Unit (10 and 13), respectively, to yield TDAE-1 and TDAE-2 and HACE (14) products, at the same time recovering all the solvent and diluents for continues reutilization.

The process for TDAE-1 and TDAE-2 production in the present invention is started with DAE feed making by mixing the components of DAE-1, DAE-2 and DAE-3; or using a single type of DAE. The mixing manner can be applied to two or three types of the DAE. The formula determination is based on the kinematic viscosities at temperature of 100° C. for each component of DAE-1, DAE-2 and DAE-3 so that they yield DAE Feed with the kinematic viscosity at 100° C. between 24 to 67 with density of 0.98-1.20 kg/liter. The mixing process are conducted in-line or off-line and completed with stirring them in a container.

The next process is mixing the DAE feed and diluent of alkane compound/paraffin that have chain of carbon atom range C5-C8. The ratio of the mixing between the diluent and the DAE Feed is 0.3-3.0, preferably at 1.0. This is done using an equipment that can control and that arrange the amount of diluent flow into the flow of DAE Feed, so that yield Mixture of DAE Feed with density between 0.75 to 0.80 kg/liter.

This flow of Mixture of DAE Feed then become next feed at liquid-liquid extraction process in the extracttor (7). Uniquely, this extractor consist of some compartments, wherein each compartment provided with one static disc and one turbine agitator which is revolvable in accordance with the desired operation condition. The turbine agitator function to disperse each of flow to become droplet so that a perfect extraction process may take place at a minimum density difference of 0.05 kg/liter.

The extraction process of Mixture of DAE feed in the extractor is carried out using certain solvent, such as furfural, NMP and DMSO as polar solvent. The operation condition is arranged in a manner such that the isothermic temperature at upper and lower extractor are at 22-35° C. achieved, with rotational speed of agitator 75-100 RPM, and the ratios of certain solvent such as furfural, NMP and DMSO and the DAE mixture feed range 0.5-2.0. With the ratio of polar solvent to DAE mixture feed ranges 1.7-2.0 a TDAE-1 containing PAH less than 10 mg/kg and BaP less than 1 mg/kg with PCA less than 3% weight will be yielded. In addition, when the ratio of polar solvent to DAE mixture feed ranges 0.5-1.7 a TDAE-2 containing PAH less than 10 mg/kg and BaP less than 1 mg/kg with PCA less than 3% weight will be yielded.

The extraction process requires 15-30 minute time for retention of Mixture of DAE Feed so that the layers of mixture of raffinate and mixture of extract are formed. During this process no pseudo raffinate is present such that occurs in the other regular extraction processes.

The interface layer of the two mixtures (mixture of raffinate and mixture of extract) can be set through a control equipment disposed at the lower portion of the extractor. The placement of the equipment at the lower portion is to prevent the undesirables extract flow (entrainment) from entering the flow of raffinate which may lower the quality of the raffinate.

The mixture of raffinate is led into the solvent recovery unit for separation of raffinate from its certain solvent components, like furfural, NMP and DMSO and diluent.

From this process an end product will yielded, that is TDAE-1 or TDAE-2, which have the kinematic viscosities at temperature of 100° C. (ASTM D445-06) above 16 cSt, the aromatic component analysed using the method of ASTM D 2140-97 ranges 25-38% weight, specific gravity at 15.6° C. ranges 0.966-0.988, aniline point ranges 43.0-75.0° C., refraction index at 20° C. ranges 1.5379-1.5546.

The mixture of extract is led into the recovery unit for extract separation process from its certain solvent component, like furfural, NMP and DMSO. From this process an end product, that is, HACE will be obtained.

Flow of certain solvents, like furfural, NMP and DMSO and the diluent from solvent recovery unit are collected at one particular decanter (container) henceforth conducted separation process between diluent and the certain solvent, like furfural, NMP and DMSO. Both of the flow is returned back into the extraction process that run continuously.

The TDAE-1 and TDAE-2 being produced will be utilized as process oil in the tyre manufacturing and in the printing ink replacing the DAE that will be totally eliminated from its application due to its poor health effects due to the content of carcinogen substances.

EXAMPLES

Example 1

Preparation of DAE Feed

The extract of DAE-1, DAE-2, and DAE-3 are prepared according to their properties as can be seen in the Table 1, respectively. The mixing process of the two or three DAE are conducted at the kinematic viscosity desired, that is, at temperature of 100° C., is 24 to 60 cSt. The formula determination is based on the kinematic viscosities of each component of DAE-1, DAE-2 and DAE-3, respectively, so that they can yield the desired. DAE Feed Mixing process are conducted in-line or off-line and completed with stirring them in a container.

TABLE 1

The properties of DAE Feed

| Parameter | DAE-1 | DAE-2 | DAE-3 |
|---|---|---|---|
| Refractive index at 70° C. | 1.4585-1.4640 | 1.488-1.489 | 1.476-1.481 |
| Specific gravity at 70° C. | 0.8200-0.8235 | 0.8600-0.8700 | 0.770-0.9000 |
| Flash point, ° C. | Minimum 240 | Minimum 240 | Minimum 240 |
| Kinematic viscosity at 100° C. | 14-17 | 19-35 | 52-95 |
| Kinematic viscosity at 60° C. | 17.3-20 | — | — |
| Kinematic viscosity at 40° C. | 449 | 2555 | 11664 |
| Furfural content, mg/kg | Maximum 100 | Maximum 100 | Maximum 100 |

TABLE 2

The physical analysis of DAE Feeds.

| Parameter | Result of DAE Feed Test | | |
|---|---|---|---|
| | DAE Feed 1 | DAE Feed 2 | DAE Feed 3 |
| Specific gravity API | 4.43 | — | — |
| Aniline Point, ° C. | 31.8 | — | — |
| Color ASTM | 2.0 | — | — |
| Density at 15.6° C., kg/m$^3$ | 1.040 | — | — |
| Flash point, ° C. | 243 | — | — |
| Pour point, ° C. | 15 | — | — |
| Refractive index at 20° C. | 1.5988 | — | — |
| Refractive Intercept | 1.0802 | — | — |
| Specific gravity at 15.6° C. | 1.0410 | — | — |
| Viscosity gravity constant | 0.9989 | — | — |
| Kinematics Viscosity at 100° C., cSt | 32.35 | 22.68 | 32.57 |
| Viscosity Saybolt at 98.9° C., SUS | 160.6 | — | — |
| Sulphur, % weight | — | — | 5.37 |
| Carbon atom Type | — | 48.0 | 49.0 |
| $C_A$, % weight | | | |
| $C_N$, % weight | — | 21.0 | 18.0 |
| $C_P$, % weight | — | 31.0 | 33.0 |
| PCA, % weight | 28.8 | 25.9 | 26.2 |

TABLE 3

The composition of Polyaromatic Hydrocarbon DAE Feeds.

| Unit | Σ EC | DAE-Feed 1 (mg/kg) *** | DAE-Feed 2 (mg/kg) |
|---|---|---|---|
| Phenantrene | | 4.410 | 6.263 |
| Antracene | | <0.001 | 0.060 |
| Fluoranthene | | 0.226 | 0.303 |
| Pyrene | | 1.960 | 3.075 |
| Benzo (b) nafto (2,1-d) tiofena | | 51.128 | 74.846 |
| Benzo (g, h, i) fluoranthene | | 1.042 | 1.661 |
| Benzo (c) phenantrene | | 0.918 | 1.458 |
| Benzo (a) antracene | ✓ | 1.724 | 2.345 |
| Cyclopenta (c,d) pyrene | | <0.001 | <0.001 |
| Tripenilene/chrysene | | 34.376 | 44.763 |
| Chrysene | ✓ | 12.186 | 15.577 |
| Benzo (b) fluoranthene | ✓ | 18.500 | 20.668 |
| Benzo (j) fluoranthene | ✓ | 1.482 | 2.577 |
| Benzo (k) fluoranthene | ✓ | 2.764 | 3.321 |
| Benzo (b+j+k) fluoranthene | | 22.746 | 26.566 |
| Benzo (e) Pyrene | ✓ | 64.848 | 66.933 |
| Benzo (a) pyrene | ✓ | 4.058 | 4.658 |
| Perylene | | 0.994 | 3.321 |
| Indeno (1,2,3-cd) pyrene | | 1.100 | 1.347 |
| Dibenzo (a,h) antracene | ✓ | 1.328 | 0.637 |
| Benzo (g,h,i) perylene | | 19.726 | 15.373 |
| Antracene | | 1.174 | 1.207 |
| Coronene | | 4.978 | 2.759 |
| Σ PAH* | | 251.668 | 299.718 |
| Σ EC** | | 106.890 | 116.716 |
| PCA | | 28.8 | 25.9 |

Note:
*Σ PAH is the sum of all individual polyaromatic hydrocarbon compounds.
**Σ EC is the sum of 8 types of individual polyaromatic hydrocarbon compound (8 Grimmer PAH) that are restricted according to European Legislation No. 2005/69/EC.
***Calculated from PAH of DAE Feed Mixture 1, which is a mixture of DAE Feed 1 and Diluent at ratio of 1:1.

For example, the amount of 8 Grimmer PAH content disclosed at Table 3 is 106,890 mg/kg. In the process of the present invention, it is found that TDAE product can be lowered to 10 mg/kg, including the Benzo(a) pyrene with the amount of less than 1 mg/kg.

Example 2

Preparation of the Mixture of Feeds

DAE Feed is mixed with a non polar aliphatic diluent with the chain of carbon from C5 to C8 and with ratio of diluent to the DAE Feed between 0.3 to 3.0. The process of feed mixing is executed at temperature of 25 to 70° C. The data on the density after the mixing process is shown at Table 4.

TABLE 4

The density of diluents.

| Type of Diluent | Carbon atom Amount | Density (kg/liter) |
|---|---|---|
| n-pentane | 5 | 0.63 |
| isopentane | 5 | 0.62 |
| n-hexane | 6 | 0.66 |
| n-heptane | 7 | 0.68 |

TABLE 4-continued

The density of diluents.

| Type of Diluent | Carbon atom Amount | Density (kg/liter) |
|---|---|---|
| n-octane | 8 | 0.70 |
| isooctane | 8 | 0.69 |

Note:
DAE Feed Mixture 1 resulted from mixing DAE Feed 1with n-hexane at a ratio of 1 resulted density of 0.81 kg/liter.

Example 3

Process of Liquid-Liquid Extraction

The process of liquid-liquid extraction to produce process oil is conducted using counter current method in an extraction column at temperature of 22 to 50° C. From the result of liquid-liquid extraction process above, the yield of TDAE-1 and TDAE-2 products between 40 to 50% weight and 50% to 70% weight are obtained, respectively, as shown in Table 5 for the operation condition, Table 6 for chemical properties, and Table 7 for physical properties.

TABLE 5

The operation conditions.

| | TDAE - 1 | | TDAE - 2 | | | |
|---|---|---|---|---|---|---|
| Parameters | Example 10 | Example 11 | Example 7 | Example 8 | Example 9 | Example 13 |
| Flow of Mixture of DAE Feed, kg/hour | 10.80 | 10.80 | 15.80 | 15.80 | 15.80 | 16.80 |
| Flow of solvent, kg/hour | 20.00 | 20.00 | 15.00 | 10.00 | 15.00 | 8.00 |
| Flow of Mixture of raffinate phase, kg/hour | 6.17 | 6.26 | 11.80 | 12.70 | 11.67 | 14.51 |
| Flow of Mixture of extract phase, kg/hour | 24.62 | 24.37 | 19.20 | 13.00 | 19.12 | 10.52 |
| Ratio DAE Mix/Furfural | 1:2 | 1:2 | 1:1 | 1:0.67 | 1:1 | 2:1 |
| Temperature, ° C. | 25 | 35 | 25 | 25 | 25 | 25 |
| PCA, % weight | 2.2 | 2.3 | 8.0 | 10.4 | 5.9 | 13.2 |
| Yield, % weight | 43.2 | 42.8 | 56.4 | 63.6 | 55.8 | 65.7 |
| Σ EC, mg/kg **** | 0.001 | 0.014 | Trace | 0.017 | 0.003 | 0.273 |
| BaP, mg/kg **** | <0.001 | <0.001 | <0.001 | 0.005 | <0.001 | 0.033 |

**** Result of TDAE Mixture (Raffinate) test.

TABLE 6

The chemical properties of TDAE products.

| | TDAE Mix - 1 | | TDAE Mix - 2 | | | |
|---|---|---|---|---|---|---|
| Unit (mg/kg) | Example 10 | Example 11 | Example 7 | Example 8 | Example 9 | Example 13 |
| Phenantrene | 0.016 | 0.082 | 0.012 | 0.015 | 0.017 | 0.102 |
| Antracene | 0.001 | 0.005 | <0.001 | <0.001 | 0.001 | <0.001 |
| Fluoranthene | 0.002 | 0.0013 | 0.002 | 0.003 | 0.003 | 0.013 |
| Pyrene | 0.002 | 0.008 | 0.002 | 0.007 | 0.003 | 0.028 |
| Benzo(b)nafto(2,1-d)tiofene | 0.001 | 0.004 | 0.010 | 0.038 | 0.007 | 0.484 |
| Benzo(g,h,i)fluoranthene | <0.001 | <0.001 | <0.001 | 0.004 | 0.001 | 0.046 |
| Benzo(c)phenantrene | <0.001 | <0.001 | <0.001 | 0.002 | 0.001 | 0.040 |
| Benzo(a)antracene * | <0.001 | <0.001 | <0.001 | 0.005 | <0.001 | 0.026 |
| Cyclopenta(c,d)pyrene | <0.001 | <0.001 | <0.001 | <0.001 | <0.001 | <0.001 |
| Tripenilena/chrysene | 0.001 | 0.005 | <0.001 | 0.011 | 0.001 | 0.083 |

TABLE 6-continued

The chemical properties of TDAE products.

| Unit (mg/kg) | TDAE Mix - 1 Example 10 | TDAE Mix - 1 Example 11 | TDAE Mix - 2 Example 7 | TDAE Mix - 2 Example 8 | TDAE Mix - 2 Example 9 | TDAE Mix - 2 Example 13 |
|---|---|---|---|---|---|---|
| Chrysene * | <0.001 | 0.002 | <0.001 | 0.004 | <0.001 | 0.024 |
| Benzo(b)fluoranthene * | <0.001 | 0.003 | <0.001 | <0.001 | 0.001 | 0.021 |
| Benzo(j)fluoranthene * | <0.001 | <0.001 | <0.001 | <0.001 | <0.001 | 0.040 |
| Benzo(k)fluorantena * | <0.001 | <0.001 | <0.001 | <0.001 | <0.001 | 0.035 |
| Benzo(b + j + k)fluoranthene | — | 0.003 | <0.001 | — | 0.001 | 0.096 |
| Benzo(e)Pyrene * | 0.001 | 0.009 | <0.001 | 0.003 | 0.002 | 0.094 |
| Benzo(a)pyrene * | <0.001 | <0.001 | <0.001 | 0.005 | <0.001 | 0.033 |
| Perylene | <0.001 | <0.001 | <0.001 | 0.002 | <0.001 | 0.011 |
| Indeno (1,2,3-cd)pyrene | <0.001 | <0.001 | <0.001 | <0.001 | <0.001 | 0.018 |
| Dibenzo(a,h) Antracene * | <0.001 | <0.001 | <0.001 | <0.001 | <0.001 | <0.001 |
| Benzo (g,h,i)perylene | <0.001 | 0.004 | <0.001 | 0.001 | 0.006 | 0.028 |
| Antracene | <0.001 | <0.001 | 0.002 | <0.001 | <0.001 | 0.023 |
| Coronene | <0.001 | 0.003 | 0.004 | <0.001 | <0.001 | 0.017 |
| Σ PAH | 0.026 | 0.004 | 0.101 | 0.025 | 0.135 | 1.142 |
| Σ EC * | 0.01 | 0.014 | — | 0.017 | 0.003 | 0.273 |
| Benzo(a)pyrene | <0.001 | <0.001 | <0.001 | 0.005 | <0.001 | 0.033 |
| PCA | 2.2 | 2.3 | 8.0 | 10.4 | 5.9 | 13.2 |

For example, Table 6 discloses the amount of 8 Grimmer PAH content is 0.001-0.273 mg/kg, which is considered far below the limit of PAH allowed by the European legislation (10 mg/kg), whereas it is found that the highest content of Benzo(a)pyrene is 0.033 mg/kg which is still below the allowable limit of the European Legislation (1 mg/kg). In some experiments of the present invention, it is found that TDAE product can fulfill the PAHs allowable limit of the European Legislation at the same time met the PCA limit of less than 3% weight. However, on other experiments the TDAE can meet the same PAH limit although the PCA content is higher than 3% weight, even as high as 13.2% weight. This fact will be very useful for the European Legislation that will limit the amount of 8 Grimmers PAH content substantially less than 10 mg/kg, where one of them is Benzo(a)pyrene at amount of less than 1 mg/kg. Besides it will be useful for the European Legislation, the present invention will give new benefits for rubber industry for providing TDAE product with better quality compared to other TDAE products, which is aromatic component content more than 25%, even can reach 30-35% by using ASTM D 2140-97 method.

TABLE 7

The physical analysis of TDAE products.

| No. | Parameter | Method | TDAE-1 | TDAE-2 |
|---|---|---|---|---|
| 1 | Specific gravity at 15.6/15.6° C. | ASTM D1298 | 0.9661 | 0.9885 |
| 2 | Kinematic viscosity at 100° C., cSt | ASTM D445 | 16.58 | 19.73 |
| 3 | Kinematic viscosity at 40° C., cSt | ASTM D445 | 327.2 | 519.8 |
| 4 | Refractive index at 20° C. | ASTM D1218-02(07) | 1.5379 | 1.5546 |
| 5 | Viscosity Gravity Constant | ASTM D2501-91 (05) | 0.915 | 0.944 |
| 6 | Sulphur % weight | ASTM D4294-08a | 3.75 | 4.35 |
| 7 | Flash point, ° C. | ASTM D92-05a | 262 | 248 |
| 8 | Aniline Point, ° C. | ASTM D611-07 | 54.9 | 43.0 |
| 9 | Carbon atom Type $C_A$, % weight | ASTM D2140 | 31.0 | 37 |
| 10 | $C_N$, % weight | ASTM D2140 | 34.0 | 33 |
| 11 | $C_P$, % weight | ASTM D2140 | 35.0 | 30 |
| 12 | Polycyclic aromatics, % weight | IP 346 | 2.7 | 8.0 |

Example 4

AMES Test on DAE Feed, TDAE-1 and TDAE-2

The mutagenity test was conducted using AMES Test based on OECD Guidelines for Testing of Chemicals No. 471 (1997). In this test *Salmonella typhimurium* TA 1535 was used as microbe material which was very sensitive to mutagenic compound. The number of colony which grew was an indicator of mutagenic activity of the PAH compound in the DAE Feed, TDAE-1 and TDAE-2, respectively. Based on the AMES Test as shown in Table 8, the following conclusions are drawn:

1. The bacteria colony in the DAE Feed grew four (4) times than that grew in the control (spontaneous reversion of the colony). This indicates that DAE Feed product can be classified as mutagenic or carcinogenic compound.
2. The number of bacteria colony in the TDAE-1 and TDAE-2 was similar to that in the control (spontaneous reversion of the colony). This indicates that TDAE-1 and TDAE-2 products can be classified as non-mutagenic or non-carcinogenic compound.

TABLE 8

The result of Mutagenic Test (Ames test).

| No. | Type of Test | Average Number of Colony Koloni | |
|---|---|---|---|
| | | Without S-9 Mix | With S-9 Mix |
| 1 | Spontaneous Reversion (Colony Control) | 330 | 430 |
| 2 | Mutagenicity Test | | |
| | a. DAE Umpan (without dilution) * | 1865 | ♂ |
| | b. TDAE-1 (without dilution) * | 324 | 351 |
| | c. TDAE-2 (without dilution ) * | 335 | 417 |
| | d. DMSO | 314 | 377 |
| 3 | Mutagenicity Test | | |
| | a. DAE Umpan (dilution 1:1) | 495 | 529 |
| | b. TDAE-1 (dilution 1:1) | 163 | 200 |
| | c. TDAE-2 (dilution 1:1) | 155 | 217 |
| 4 | Mutagenicity Test | | |
| | a. DAE Umpan (dilution 1:10) | 378 | 427 |
| | b. TDAE-1 (dilution 1:10) | 43 | 107 |
| | c. TDAE-2 (dilution 1:10) | 17 | 91 |
| 5 | Toxicity Test | | |
| | a. DAE Feed<br>b. TDAE-1<br>c. TDAE-2<br>d. DMSO | No inhibitory zone (no toxic to microorganism tested) | Not Conducted |

♂ Too many colonies were present so that it was uncountable.

*The table below indicate the level of PCA, B(a)P and PAH contained in the respective product as mentioned above:

| | PCA % weight | B (a) P mg/kg | 8 Grimmer PAH mg/kg |
|---|---|---|---|
| a. DAE feed (without dilution) | 28.8% | 4.058 | 106.890 |
| b. TDAE-1 (without dilution ) | 2.2% | <0.001 | 0.001 |
| c. TDAE-2 (without dilution ) | 8% | <0.001 | trace |

<Term and Definition Used in the Specification of this Application>

In the specification of this application, "Liquid-liquid extraction" is a technological process which based on method of operation of mass transfer to a feed that is contacted with a solvent for extracting dissolvable substances (solute) from feed materials. Feed materials, which consist of carrier and solute must have a property, that is, cannot be mixed (immiscible) or can be mixed partially (miscible) with the solvent, so that only solute that have higher solvability than the diluents can move into the solvent.

"Diluent" is an alkane compound that used to lower the density of feed materials.

"Extractor" is a type of agitation column extractor used in the experiments of the present invention, hereinafter referred to as extractor. The main part of this extractor is a turbine agitator which can be operated on the hydrodynamic conditions and serves as a stirrer to generate droplets spread.

"PCA or Polycyclic Aromatic", is organic compound that consist of 3 or more rings of aromatic compound with or without branch chain, where in the PCA are contained PAH (Polycyclic Aromatic Hydrocarbon) compound and organic compound that contain hetero-atom like Nitrogen (N), Sulphur (S) and Oxygen (O). Not all compound that grouped as PAH have the property of carcinogenic.

"PAH or Polycyclic Aromatic Hydrocarbon" is chemical compound that consist of aromatic ring bonding and does not contain hetero-atom or other substituent, consist of carbon and hydrogen molecules. There are 23 types individual PAH compounds in DAE Feed where 8 types of them stated as carcinogenic substances or called 8 Grimmer PAH.

"Process Oil" is oil which is rich in aromatic compound, used as solvent in the tire making or may also be used as a solvent at the printing ink industry.

"IP 346 is the standard method to determine PCA in lubricating oil or petroleum fraction that does not contain asphaltene.

While the present invention is described related to the embodiments as illustrated herein after, as well as the accompanied drawing, it has to be understood that they are not intended to represent the only form of the invention in regard to the details of the process and manner of operation. In fact, it will be evident to one skill in the art that modifications and variations may be made without departing from the spirit and the scope of the invention. Although specific terms have been employed, they are intended in a generic and descriptive sense only and not for the purpose of limitation.

The invention claimed is:

1. A process for producing treated distillate aromatic extract (TDAE)-1 or treated distillate aromatic extract (TDAE)-2 comprising the following steps:

a. preparing a distillate aromatic extract (DAE) Feed by mixing one, two or three different DAE having different kinematic viscosities, wherein the process for producing the DAE comprises a furfural solvent extraction, b. mixing the DAE Feed obtained at the step a above with a diluent to obtain a mixture of DAE Feed having a density of 0.75-0.85 kg/liter, wherein the diluent is selected from n-pentane, isopentane, n-hexane, n-heptane, n-octane and isooctane, c. directing the mixture of DAE Feed to an extractor that has an isothermic temperature, ranges 22-35° C., d. contacting the mixture of DAE Feed with a furfural solvent so that a liquid-liquid extraction process with counter current technique take place at an isothermic temperature, ranges 22-35° C., e. adjusting a process of separation of interface layers in the extractor thereby transporting a mixture of raffinate and a mixture of extract through a control equipment placed at the lower portion of the column, and f. directing the mixture of raffinate to a solvent recovery unit to separate out the solvent and the diluent from the mixture of raffinate to yield an end product TDAE-1 or TDAE-2, wherein TDAE-1 contains polycyclic aromatic (PCA less than 3% weight and 8 Grimmers polyaromatic hydrocarbon (PAH) less than 10 mg/kg and benzo(a)pyrene (BaP) less than 1 mg/kg, and wherein TDAE-2 contains PCA of 3%-20% weight and 8 Grimmers PAH less than 10 mg/kg and BaP less than 1 mg/kg.

2. The process according to claim 1, characterized in that the process further comprises a step of:

g. directing a flow of mixture of extract at the step e to a solvent recovery unit to separate out the solvent and the diluent from the mixture of extract then yield an end product with high aromatic concentration extract (HACE).

3. The process according to claim 2, characterized in that the process further comprises a step of:

h. collecting the solvent and the diluent separated out at the step f and g above into a container for reutilization at a next extraction process.

4. The process according to claim 1, wherein a ratio of diluents to DAE Feed ranges 0.3-3.0.

5. The process according to claim 4, wherein the ratio of diluent to DAE Feed is 1.

* * * * *